US009457452B2

(12) United States Patent
Nakai

(10) Patent No.: US 9,457,452 B2
(45) Date of Patent: Oct. 4, 2016

(54) METHOD FOR PRODUCING LAMINATED POLISHING PAD

(71) Applicant: TOYO TIRE & RUBBER CO., LTD., Osaka-shi, Osaka (JP)

(72) Inventor: Yoshiyuki Nakai, Osaka (JP)

(73) Assignee: ROHM AND HAAS ELECTRONIC MATERIALS CMP HOLDINGS, INC., Newark, DE (US)

( * ) Notice: Subject to any disclaimer, the term of this patent is extended or adjusted under 35 U.S.C. 154(b) by 20 days.

(21) Appl. No.: 14/370,923

(22) PCT Filed: Jan. 9, 2013

(86) PCT No.: PCT/JP2013/050236

§ 371 (c)(1),
(2) Date: Jul. 7, 2014

(87) PCT Pub. No.: WO2013/108694

PCT Pub. Date: Jul. 25, 2013

(65) Prior Publication Data

US 2015/0004879 A1 Jan. 1, 2015

(30) Foreign Application Priority Data

Jan. 17, 2012 (JP) ..... 2012-007220

(51) Int. Cl.
*B24B 37/22* (2012.01)
*B24D 11/00* (2006.01)
*B24B 37/24* (2012.01)

(52) U.S. Cl.
CPC ..... *B24D 11/003* (2013.01); *B24B 37/22* (2013.01); *B24B 37/24* (2013.01); *B24D 11/008* (2013.01)

(58) Field of Classification Search
CPC ..... B24B 37/22; B24B 37/24; B24D 11/003; B24D 11/008
USPC ..... 51/297
See application file for complete search history.

(56) References Cited

U.S. PATENT DOCUMENTS

2005/0070216 A1* 3/2005 Roberts ..... B24B 37/22 451/433
2005/0150594 A1* 7/2005 Kodaka ..... B24B 37/22 156/307.7

(Continued)

FOREIGN PATENT DOCUMENTS

JP 2006265410 A * 10/2006
JP 2007260801 A 10/2007

(Continued)

OTHER PUBLICATIONS

JP 2006-265410 A—Oct. 2006 English Machine Translation.*

(Continued)

*Primary Examiner* — Joseph J Hail
*Assistant Examiner* — Marc Carlson
(74) *Attorney, Agent, or Firm* — Law Office of Katsuhiro Arai

(57) ABSTRACT

A method for producing a laminated polishing pad, which is free from warpage and does not cause peeling between a polishing layer and a cushion layer during polishing, includes the steps of: laminating a hot-melt adhesive sheet to a surface of a cushion layer with a base material in which a thermoplastic resin base material is provided peelably on one surface of the cushion layer, on which the thermoplastic resin base material is not provided; heating the laminated hot-melt adhesive sheet to be melted or softened; laminating a polishing layer on the melted or softened hot-melt adhesive to prepare a laminate; cutting the laminate to the size of the polishing layer to prepare a laminated polishing sheet; and peeling the thermoplastic resin base material from the laminated polishing sheet.

16 Claims, 1 Drawing Sheet

(56) References Cited

U.S. PATENT DOCUMENTS

| | | | | |
|---|---|---|---|---|
| 2008/0274674 | A1 | 11/2008 | Prasad et al. | |
| 2009/0075568 | A1* | 3/2009 | Kimura | B24B 37/26 451/59 |
| 2010/0012269 | A1* | 1/2010 | Jensen | B24B 37/22 156/289 |
| 2012/0276402 | A1 | 11/2012 | Kitamura et al. | |
| 2012/0322348 | A1 | 12/2012 | Yokoi et al. | |

FOREIGN PATENT DOCUMENTS

| | | | | |
|---|---|---|---|---|
| JP | 2008272922 | A | * | 11/2008 |
| JP | 2009190107 | A | * | 8/2009 |
| JP | 2010028113 | A | | 2/2010 |
| JP | 2010525956 | A | | 7/2010 |
| JP | 2011115935 | A | | 6/2011 |
| JP | 2011151373 | A | | 8/2011 |
| TW | 201125651 | A | | 8/2011 |

OTHER PUBLICATIONS

JP 2008-272922 A—Nov. 2008 English Machine Translation.*

An Office Action Issued by the Taiwan Intellectual Property Office, mailed Feb. 12, 2015, with a Search Report (Feb. 2, 2015) for Taiwanese related application No. 102101614.

A Notice to Submit a Response issued by Korean Intellectual Property Office, mailed May 26, 2015, for Korean counterpart application No. 1020147010135.

Notification of Transmittal of Translation of the International Preliminary Report on Patentability (PCT/IB/338) mailed Jul. 31, 2014, with International Preliminary Report on Patentability (PCT/IB/373) and Written Opinion of the International Searching Authority (PCT/ISA/237), for corresponding international application PCT/JP2013/050236.

International Search Report (ISR) mailed Feb. 26, 2013, issued for International application No. PCT/JP2013/050236.

* cited by examiner

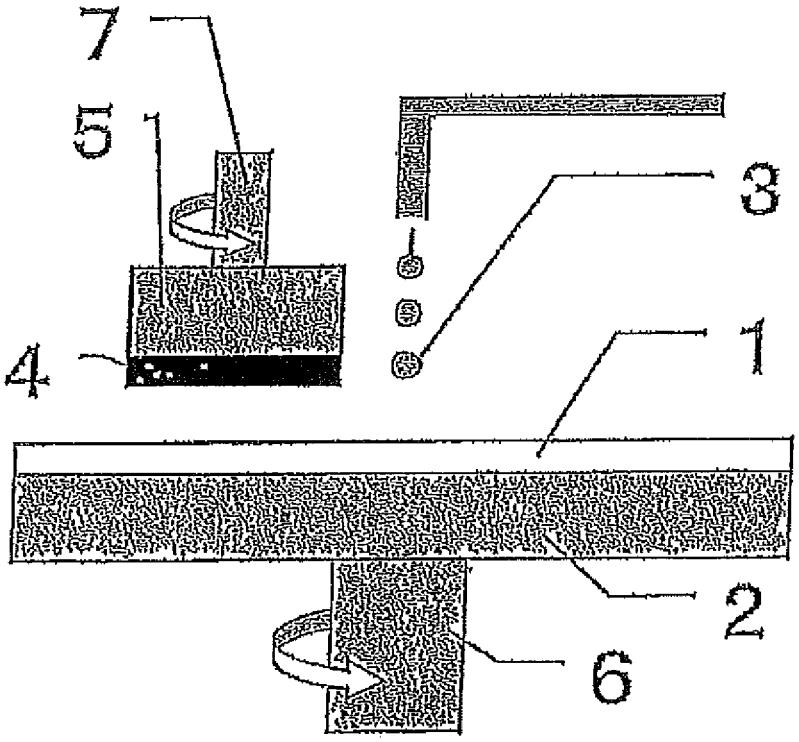
7
5
3
4
1
2
6

METHOD FOR PRODUCING LAMINATED POLISHING PAD

This application is the U.S. National Phase under 35 U.S.C. §371 of International Application PCT/JP2013/050236, filed Jan. 9, 2013, which claims priorities to Japanese Patent Applications No. 2012-007220, filed Jan. 17, 2012. The International Application was published under PCT Article 21(2) in a language other than English.

TECHNICAL FIELD

The present invention relates to a laminated polishing pad by which the planarizing processing of optical materials such as lenses, reflecting mirrors and the like, silicon wafers, glass substrates for hard disks, aluminum substrates, and materials requiring a high degree of surface planarity such as those in general metal polishing processing can be carried out stably with high polishing efficiency. The laminated polishing pad of the present invention is used particularly preferably in a process of planarizing a silicone wafer, and a device having an oxide layer, a metal layer or the like formed on a silicon wafer, before lamination and formation of the oxide layer, the metal layer or the like.

BACKGROUND ART

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with slurry having abrasive grains dispersed therein. As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-sided tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

Conventional polishing pads for use in high-precision polishing are generally produced using a polyurethane resin foam sheet. Unfortunately, such a polyurethane resin foam sheet has insufficient cushioning properties and therefore can hardly apply uniform pressure to the entire surface of a wafer, though it has high local-planarization performance. In general, therefore, a soft cushion layer is additionally provided on the back side of such a polyurethane resin foam sheet, and the resulting laminated polishing pad is used for polishing.

However, conventional laminated polishing pads have the problem that since a polishing layer and a cushion layer are usually bonded to each other by a double-sided tape, a slurry infiltrates between the polishing layer and the cushion layer during polishing, or durability of the double-sided tape is reduced by heat generated during polishing (the pad surface temperature rises to about 80° C. in the case where a ceria slurry is used or the case of metal polishing), so that the polishing layer and the cushion layer are easily peeled from each other.

Examples of proposed methods to solve this problem include the techniques described below.

Patent Document 1 discloses a method for producing a multiple-layer chemical mechanical polishing pad, including disposing an uncured reactive hot-melt adhesive between a polishing layer and a sub-pad layer, and pressing the two layers against each other to cure the uncured reactive hot-melt adhesive, thereby forming a reactive hot-melt adhesive bond between the two layers.

Patent Document 2 discloses a polishing pad in which a polishing layer and a lower layer are joined to each other with a hot-melt adhesive containing EVA.

Patent Document 3 discloses a polishing pad formed by bonding and laminating a polishing layer, which includes a fabric or open-type lattice structure having an aperture of 10 to 100 μm, to a support with an adhesive layer of a fused thermoplastic resin interposed therebetween.

However, if a polishing layer and a cushion layer are bonded to each other with a hot-melt adhesive as in conventional production methods, there is the problem that warpage easily occurs in the obtained laminated polishing pad.

PRIOR ART DOCUMENTS

Patent Documents

Patent Document 1: JP-A-2010-28113
Patent Document 2: JP-A-2010-525956
Patent Document 3: JP-A-2011-115935

SUMMARY OF THE INVENTION

Problems to be Solved by the Invention

An object of the present invention is to provide a method for producing a laminated polishing pad which is free from warpage and does not cause peeling between a polishing layer and a cushion layer during polishing.

Means for Solving the Problems

As a result of earnest investigations to solve the problems, the inventors have accomplished the invention based on the finding that the object can be achieved by a method for producing a laminated polishing pad shown below.

Specifically, the invention is directed to a method for producing a laminated polishing pad comprising the steps of:

laminating a hot-melt adhesive sheet to a surface of a cushion layer with a base material in which a thermoplastic resin base material is provided peelably on one surface of the cushion layer, on which the thermoplastic resin base material is not provided;

heating the laminated hot-melt adhesive sheet to be melted or softened;

laminating a polishing layer on the melted or softened hot-melt adhesive to prepare a laminate;

cutting the laminate to the size of the polishing layer to prepare a laminated polishing sheet; and peeling the thermoplastic resin base material from the laminated polishing sheet.

The another invention is directed to a method for producing a laminated polishing pad comprising the steps of:

applying a melted or softened hot-melt adhesive to a surface of a cushion layer with a base material in which a thermoplastic resin base material is provided peelably on one surface of the cushion layer, on which the thermoplastic resin base material is not provided;

laminating a polishing layer on the melted or softened hot-melt adhesive to prepare a laminate;

cutting the laminate to the size of the polishing layer to prepare a laminated polishing sheet; and peeling the thermoplastic resin base material from the laminated polishing sheet.

If a laminated polishing pad is produced by bonding a polishing layer and a cushion layer to each other in a continuous production system (line production system), a failure such as generation of winkles or an adhesion failure easily occurs during bonding because the cushion layer is poor in rigidity. For preventing such a failure, a cushion layer with a base material, in which a thermoplastic resin base material is provided on one surface of the cushion layer to impart rigidity, is used.

However, if a polishing layer and a cushion layer with abase material are bonded to each other with a hot-melt adhesive, significant warpage tends to occur in the obtained laminated polishing pad. As a reason for this, the present inventors have considered as follows. During bonding, a hot-melt adhesive should be heated to about 150° C. so as to be melted or softened, and at this time, heat is also applied to a polishing layer and a cushion layer with a base material. A difference in linear expansion coefficient among the polishing layer, the cushion layer and the thermoplastic resin base material when heat is applied causes a difference in behavior among the layers, leading to occurrence of warpage. As a result of conducting thorough studies, it has been found that the polishing layer and the cushion layer are expanded when heated, and then recover their original shapes when cooled, while the thermoplastic resin base material is shrunk when heated, and never recovers its original shape even when cooled, and thus the thermoplastic resin base material shows a behavior different from that of the polishing layer and the cushion layer. Accordingly, a difference in expansion/shrinkage behavior between the polishing layer and cushion layer and the thermoplastic resin base material upon heating and cooling causes occurrence of warpage in the obtained laminated polishing pad.

As in the present invention, if a laminate is cut into a size of a polishing layer to prepare a laminated polishing sheet, and thereafter a thermoplastic resin base material is peeled from the laminated polishing sheet, a laminated polishing pad free from warpage can be produced.

In the present invention, preferably the laminated polishing sheet is prepared by cutting the laminate to the size of the polishing layer before the melted or softened hot-melt adhesive is completely cured. If the laminated polishing sheet is prepared by cutting the laminate to the size of the polishing layer before the melted or softened hot-melt adhesive is completely cured, a laminated polishing pad can be produced in which the polishing layer and the cushion layer are accurately laminated. If the laminate is cut to the size of the polishing layer after the hot-melt adhesive is completely cured, the laminate must be cut with warpage of the laminate increased by cooling. Therefore, it is difficult to accurately cut the laminate to the size of the polishing layer. That is, it is difficult to cut the laminate such that the outer periphery of the polishing layer coincides with the outer periphery of the cushion layer with a base material (specifically, the laminate is cut such that the outer periphery of the cushion layer with a base material has a size larger than that of the outer periphery of the polishing layer).

In the present invention, preferably the laminated polishing sheet is prepared by cutting the laminate to the size of the polishing layer when the temperature of the hot-melt adhesive is 40° C. or higher. If the laminate is cut to the size of the polishing layer when the temperature of the hot-melt adhesive is lower than 40° C., the laminate is cut with warpage of the laminate increased by cooling, and therefore it tends to be difficult to accurately cut the laminate to the size of the polishing layer.

The production method of the present invention is particularly effective when a thermoplastic resin base material formed by stretch forming is used. If a thermoplastic resin base material formed by stretch forming is used, warpage easily occurs in a laminated polishing pad, but by employing the production method of the present invention, a laminated polishing pad free from warpage can be obtained.

In the present invention, preferably the melting temperature of the hot-melt adhesive is 140 to 170° C. When the melting temperature of the hot-melt adhesive is lower than 140° C., the adhesive strength of the hot-melt adhesive is reduced by heat generated during polishing, so that the polishing layer and the cushion layer tend to be peeled from each other. On the other hand, when the melting temperature is higher than 170° C., the polishing layer and the cushion layer tend to be deformed or degraded at the time of melting the hot-melt adhesive at such a temperature.

In the present invention, preferably the thermoplastic resin base material is a polyethylene terephthalate base material.

The method for producing a laminated polishing pad according to the present invention may include a step of providing a pressure-sensitive double-sided tape, which has a pressure-sensitive adhesive layer on both surfaces of a thermoplastic resin sheet, on a surface of the cushion layer from which the thermoplastic resin base material is peeled. The pressure-sensitive double-sided tape is used for bonding the laminated polishing pad to a polishing platen.

Moreover, the invention is directed to a method for producing a semiconductor device comprising the step of polishing a surface of a semiconductor wafer using the laminated polishing pad.

Effect of the Invention

According to the production method of the present invention, a laminated polishing pad can be easily produced which is free from warpage and does not cause peeling between a polishing layer and a cushion layer during polishing. Further, according to the production method of the present invention, a laminated polishing pad can be easily produced in which a polishing layer and a cushion layer are accurately laminated.

BRIEF DESCRIPTION OF THE DRAWINGS

FIG. 1 is a schematic diagram showing an example of a polishing apparatus used in CMP.

MODE FOR CARRYING OUT THE INVENTION

In the invention, the polishing layer is not restricted as long as it is a foam containing fine cells. For example, the material for the foam may be one of or a blend of two or more of polyurethane resin, polyester resin, polyamide resin, acrylic resin, polycarbonate resin, halogen-containing resin (such as polyvinyl chloride, polytetrafluoroethylene and polyvinylidene fluoride etc.), polystyrene, olefin resin (such as polyethylene and polypropylene etc.), epoxy resin, and photosensitive resin. Polyurethane resin is particularly preferred as a material for forming the polishing layer because polyurethane resin has good wear resistance and because urethane polymers having desired physical properties can be easily obtained through changing the composition of raw materials in various manners. Hereinafter, polyurethane resin will be described as a typical example of the material for the foam.

The polyurethane resin contains an isocyanate component, a polyol component (high-molecular-weight polyol, low-molecular-weight polyol etc.) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof.

Besides the above high-molecular-weight polyol described in the above as a polyol component, it is preferred to concomitantly use a low-molecular-weight polyol such as ethyleneglycol, 1,2-propylene glycol, 1,3-propylene glycol, 1,2-butanediol, 1,3-butanediol, 1,4-butanediol, 2,3-butanediol, 1,6-hexanediol, neopentylglyol, 1,4-cyclohexanedimethanol, 3-methyl-1,5-pentanediol, diethyleneglycol, triethyleneglycol, 1,4-bis(2-hydroxyethoxy)benzene, trimethylolpropane, glycerin, 1,2,6-hexanetriol, pentaerythritol, tetramethylol cyclohexane, methylglucoside, sorbitol, mannitol, dulcitol, sucrose, 2,2,6,6-tetrakis(hydroxymethyl) cyclohexanol, diethanolamine, N-methyldiethanolamine and triethanol amine. Low-molecular-weight polyamine such as ethylenediamine, tolylenediamine, diphenylmethanediamine, and diethylenetriamine may be used. Alcohol amine such as monoethanol amine, 2-(2-aminoethylamino) ethanol and monopropanol amine may be used. These may be used singly or in combination of two or more kinds. The content of the low-molecular-weight polyol, the low-molecular-weight polyamine, or other materials is not particularly limited, and may be appropriately determined depending on the properties required of the polishing pad (polishing layer) to be manufactured.

In the case where a polyurethane resin foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline)(MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5.5'-dimethyldiphenylmethane, 4,4'-diamino-3,3',5,5'-tetraisopropyldiphenylmethane, 1,2-bis(2-aminophenylthio) ethane, 4,4'-diamino-3,3'-diethyl-5.5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; the low-molecular-weight polyol; and the low-molecular-weight polyamine. The chain extenders described above may be used either alone or in mixture of two kinds or more.

A ratio between an isocyanate component, a polyol component and a chain extender in the invention can be altered in various ways according to molecular weights thereof, desired physical properties of a laminated polishing pad and the like. In order to obtain a laminated polishing pad with desired polishing characteristics, a ratio of the number of isocyanate groups in an isocyanate component relative to a total number of active hydrogen groups (hydroxyl groups+amino groups) in a polyol component and a chain extender is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

A polyurethane resin foam can be produced by applying a melting method, a solution method or a known polymerization technique, among which preferable is a melting method, consideration being given to a cost, a working environment and the like.

Manufacture of a polyurethane resin foam is enabled by means of either a prepolymer method or a one shot method, of which preferable is a prepolymer method in which an isocyanate-terminated prepolymer is synthesized from an isocyanate component and a polyol component in advance, with which a chain extender is reacted since physical properties of an obtained polyurethane resin is excellent.

Manufacturing methods of a polyurethane resin foam include: a method in which hollow beads are added, a mechanical foaming method, a chemical foaming method and the like.

Particularly, preferred is a mechanical foaming method using a silicone-based surfactant which is a copolymer of polyalkylsiloxane and polyether and has no an active hydrogen group.

A stabilizer such as antioxidant, a lubricant, a pigment, a filler, an antistatic agent and other additives may be added, as needed.

The polyurethane resin foam may be of a closed cell type or an open cell type.

Production of the polyurethane resin foam may be in a batch system where each component is weighed out, introduced into a vessel and mixed or in a continuous production system where each component and a non-reactive gas are continuously supplied to, and stirred in, a stirring apparatus and the resulting forming reaction liquid is transferred to produce molded articles.

A manufacturing method of a polyurethane resin foam may be performed in ways: in one of which a prepolymer which is a raw material from which a polyurethane foam is made is put into a reactor, thereafter a chain extender is mixed into the prepolymer, the mixture is agitated, thereafter the mixture is cast into a mold with a predetermined size to thereby prepare a block and the block is sliced with a slicer like a planer or a band saw; and in another of which in the step of casting into the mold, a thin sheet may be directly produced. Besides, a still another way may be adopted in which a resin of raw material is melted, the melt is extruded through a T die to thereby mold a polyurethane resin foam directly in the shape of a sheet.

An average cell diameter of a polyurethane resin foam is preferably in the range of from 30 to 80 μm and more preferably in the range of from 30 to 60 μm. If an average cell diameter falls outside the range, a tendency arises that a polishing rate is decreased and a planarity of an object to be polished (a wafer) after polishing is reduced.

Preferably, the polyurethane resin foam has a specific gravity ranging from 0.5 to 1.3. When the specific gravity is less than 0.5, the surface strength of the polishing layer decreases, so that the planarity of the object to be polished tends to decrease. When the specific gravity is larger than 1.3, the cell number on the surface of the polishing layer decreases, so that the polishing rate tends to decrease despite excellent planarity.

Preferably, the polyurethane resin foam has a hardness measured by ASKER D hardness meter, ranging from 40 to 75 degrees. When the ASKER D hardness is less than 40 degrees, the planarity of the object to be polished decreases, while when the hardness is more than 75 degrees, the uniformity of the object to be polished tends to decrease despite excellent planarity.

Preferably, a polishing surface of the polishing layer, which comes into contact with an object to be polished have a asperity structure provided for retaining and refreshing a slurry. A polishing layer made of a foam has a number of openings in the polishing surface, and has a function of retaining and refreshing a slurry. By forming an asperity structure on the polishing surface, it is possible to conduct retention and refreshment of the slurry more efficiently, and to prevent the object to be polished from breaking due to adsorption of the material to be polished. The shape of the asperity structure is not particularly limited insofar as it is able to retain and refresh a slurry, and for example, XY grating groove, concentric ring groove, through-hole, non-through-hole, polygonal column, circular cylinder, spiral groove, eccentric ring groove, radial groove, and combination thereof can be recited. These asperity structures generally have regularity, however, groove pitch, groove width, groove depth and the like may be varied by a certain range for achieving desired retention and refreshment of slurry.

The thickness of the polishing layer is generally, but is not limited to, about 0.8 to 4 mm, and preferably 1.2 to 2.5 mm.

The polishing layer may be provided with a transparent member for optically detecting an end point while polishing is performed.

On the other hand, the cushion layer with a base material has a thermoplastic resin base material provided peelably on one surface of the cushion layer.

The cushion layer is necessary for CMP to achieve both good planarity and good uniformity, which are usually in a trade-off relationship. The term "planarity" refers to the flatness of a patterned part formed by polishing an object to be polished having fine irregularities, which are produced in a patterning process. The term "uniformity" refers to the entire uniformity of an object to be polished. The characteristics of the polishing layer contribute to an improvement in planarity, and the characteristics of the cushion layer contribute to an improvement in uniformity.

Examples of the cushion layer include nonwoven fiber fabrics such as polyester nonwoven fabrics, nylon nonwoven fabrics, and acrylic nonwoven fabrics; resin impregnated nonwoven fabrics such as polyurethane impregnated polyester nonwoven fabrics; polymeric resin foams such as polyurethane foams and polyethylene foams; rubber resins such butadiene rubber and isoprene rubber; and photosensitive resins, etc. Among them, particularly polyurethane foams are preferably used.

Examples of the thermoplastic resin base material include polyester films such as a polyethylene terephthalate film; polyolefin films such as a polyethylene film and a polypropylene film; polyamide films; acrylic resin films; methacrylic resin films; and polystyrene films. Among them, particularly a polyethylene terephthalate film is preferably used.

The thickness of the thermoplastic resin base material is not particularly limited, but is preferably 10 to 150 μm, more preferably 20 to 100 μm.

The cushion layer with a base material can be prepared by, for example, a method in which a thermoplastic resin base material is bonded to one surface of a cushion layer with a peelable pressure-sensitive adhesive, or a method in which a cushion layer forming material is applied to the treated surface of a thermoplastic resin base material subjected to a surface peelability imparting treatment, and cured to form a cushion layer.

In the method for producing a laminated polishing pad according to the present invention, first a hot-melt adhesive sheet is laminated to a surface of the cushion layer with a base material on which the thermoplastic resin base material is not provided.

The hot-melt adhesive as a raw material of the hot-melt adhesive sheet is not particularly limited, and one that is publicly known can be used. Examples thereof include polyester-based, ethylene-vinyl acetate resin-based, polyamide resin-based, polyurethane resin-based and polyolefin resin-based hot-melt adhesives, and particularly a polyester-based hot-melt adhesive is preferably used.

The polyester-based hot-melt adhesive contains at least a polyester resin as a base polymer and an epoxy resin having two or more glycidyl groups per molecule, in which the epoxy resin is a crosslinking component.

The polyester resin may be any known polyester resin which is obtained by condensation polymerization of an acid and a polyol or other polymerization processes. In particular, the polyester resin is preferably a crystalline polyester resin.

Examples of the acid include aromatic dicarboxylic acids, aliphatic dicarboxylic acids, and alicyclic dicarboxylic acids, etc. These may be used alone or in combination of two or more.

Examples of aromatic dicarboxylic acids include terephthalic acid, isophthalic acid, phthalic anhydride, α-naphthalene dicarboxylic acid, β-naphthalene dicarboxylic acid, and their ester forms, etc.

Examples of aliphatic dicarboxylic acids include succinic acid, glutaric acid, adipic acid, pimelic acid, suberic acid, azelaic acid, sebacic acid, undecylenic acid, dodecanedioic acid, and their ester forms, etc.

Examples of alicyclic dicarboxylic acids include 1,4-cyclohexane dicarboxylic acid, tetrahydrophthalic anhydride, hexahydrophthalic anhydride, etc.

An unsaturated acid such as maleic acid, fumaric acid, or dimer acid, a polycarboxylic acid such as trimellitic acid or pyromellitic acid, or other acids may also be used as the acid in combination with any of the above acids.

Examples of the polyol include dihydric alcohols such as aliphatic glycols and alicyclic glycols, and polyhydric alcohols. These may be used alone or in combination of two or more.

Examples of aliphatic glycols include ethylene glycol, 1,2-propylene glycol, 1,3-propylene glycol, 1,3-butanediol, 1,4-butanediol, 1,5-pentanediol, 1,6-hexanediol, 1,8-octanediol, 1,9-nonanediol, neopentyl glycol, 3-methylpentanediol, 2,2,3-trimethylpentanediol, diethylene glycol, triethylene glycol, dipropylene glycol, etc.

Examples of alicyclic glycols include 1,4-cyclohexanedimethanol, hydrogenated bisphenol A, etc.

Examples of polyhydric alcohols include glycerin, trimethylolethane, trimethylolpropane, pentaerythritol, etc.

The crystalline polyester resin can be synthesized by known methods. Examples include melt polymerization methods including adding raw materials and a catalyst and heating the mixture at a temperature equal to or higher than the melting point of the desired product, solid-phase polymerization methods including performing polymerization at a temperature equal to or lower than the melting point of the desired product, and solution polymerization methods using a solvent, etc. Any of these methods may be used.

The crystalline polyester resin preferably has a number average molecular weight of 5,000 to 50,000. If the number average molecular weight is less than 5,000, the hot-melt adhesive may have lower mechanical characteristics, so that a sufficient level of tackiness and durability may fail to be obtained. If the number average molecular weight is more than 50,000, a production failure such as gelation may occur in the process of synthesizing the crystalline polyester resin, or the hot-melt adhesive may tend to have lower performance.

Examples of the epoxy resin include aromatic epoxy resins such as bisphenol A type epoxy resins, brominated bisphenol A type epoxy resins, bisphenol F type epoxy resins, bisphenol AD type epoxy resins, stilbene type epoxy resins, biphenyl type epoxy resins, bisphenol A novolac type epoxy resins, cresol novolac type epoxy resins, diaminodiphenylmethane type epoxy resins, and polyphenyl-based epoxy resins such as tetrakis(hydroxyphenyl)ethane-based epoxy resins, fluorene-containing epoxy resins, and epoxy resins containing a triglycidyl isocyanurate moiety or a heteroaromatic ring (such as a triazine ring); and non-aromatic epoxy resins such as aliphatic glycidyl ether type epoxy resins, aliphatic glycidyl ester type epoxy resins, alicyclic glycidyl ether type epoxy resins, and alicyclic glycidyl ester type epoxy resins. These may be used alone or in combination of two or more.

Among them, cresol novolac type epoxy resins are preferably used in view of tackiness to the polishing layer and the cushion layer during polishing.

The epoxy resin is necessarily added in an amount of 2 to 10 parts by weight, preferably in an amount of 3 to 7 parts by weight, to 100 parts by weight of the polyester resin as a base polymer.

The hot-melt adhesive may also contain known additives such as a softener such as an olefin resin, a tackifier, a filler, a stabilizer, and a coupling agent. The adhesive may also contain a known inorganic filler such as talc and other materials.

The hot-melt adhesive preferably has a melting temperature of 140 to 170° C.

The hot-melt adhesive preferably has a specific gravity of 1.1 to 1.3.

The hot-melt adhesive preferably has a melt flow index of 16 to 26 g/10 minutes under the conditions of 150° C. and a load of 2.16 kg.

The hot-melt adhesive sheet preferably has a thickness of 10 to 200 μm, more preferably 30 to 150 μm.

Thereafter, the laminated hot-melt adhesive sheet is heated to be melted or softened. When the hot-melt adhesive sheet is softened, the sheet is heated preferably to a temperature within a range from a temperature lower by −10° C. than the melting temperature of the hot-melt adhesive to the melting temperature of the hot-melt adhesive, more preferably to a temperature within a range from a temperature lower by −5° C. than the melting temperature of the hot-melt adhesive to the melting temperature of the hot-melt adhesive. The method for melting or softening a hot-melt adhesive sheet is not particularly limited, and examples thereof include a method in which the surface of a hot-melt adhesive sheet is heated with an infrared heater while the sheet is conveyed on a conveyor belt.

Thereafter, a polishing layer is laminated on the melted or softened hot-melt adhesive to prepare a laminate. As another method, a laminate may be prepared by applying a melted or softened hot-melt adhesive to a surface of a cushion layer with a base material on which a thermoplastic resin base material is not provided, and laminating a polishing layer on the melted or softened hot-melt adhesive.

Preferably, after the polishing layer is laminated on the melted or softened hot-melt adhesive, the laminate is made to pass between rolls to be pressed, so that the cushion layer and the polishing layer are brought into close contact with the melted or softened hot-melt adhesive.

Then, the laminate is cut to the size of the polishing layer to prepare a laminated polishing sheet.

In the production method of the present invention, preferably the laminate is cut to the size of the polishing layer before the melted or softened hot-melt adhesive is completely cured. In the present invention, preferably the laminate is cut to the size of the polishing layer when the temperature of the hot-melt adhesive is 40° C. or higher, more preferably 50° C. or higher.

Thereafter, the thermoplastic resin base material is peeled from the laminated polishing sheet. By peeling the thermoplastic resin base material, a laminated polishing pad free from warpage is obtained. Peeling of the thermoplastic resin base material may be performed before the hot-melt adhesive is completely cured, or may be performed after the hot-melt adhesive is completely cured.

After the thermoplastic resin base material is peeled, a pressure-sensitive double-sided tape, which has a pressure-sensitive adhesive layer on both surfaces of a thermoplastic resin sheet, may be provided on a surface (platen adhesion surface) of the cushion layer from which the thermoplastic resin base material is peeled.

The thermoplastic resin sheet and the pressure-sensitive adhesive layer are not particularly limited, and ones that are common can be used, but the thermoplastic resin sheet is preferably a PET sheet. The thickness of the thermoplastic resin sheet is preferably 10 to 200 μm, more preferably 20 to 150 μm. By ensuring that the thickness of the thermoplastic resin sheet falls within the aforementioned range, the laminated polishing pad is easily bonded to a polishing platen, and the used laminated polishing pad is easily peeled from the polishing platen.

The method for providing a pressure-sensitive double-sided tape on a platen adhesion surface of a cushion layer is, for example, a method in which a pressure-sensitive double-sided tape cut to the size of a cushion layer beforehand is bonded, or a method in which a pressure-sensitive double-sided tape is bonded to a cushion layer, and the pressure-sensitive double-sided tape is then cut to the size of the cushion layer. When the pressure-sensitive double-sided tape is bonded to the thermoplastic resin base material without peeling the thermoplastic resin base material from the laminated polishing sheet, and the pressure-sensitive double-sided tape is cut to the size of the laminated polishing sheet, the laminated polishing sheet is warped, and therefore the blade of a cutter is easily caught by release paper provided on the surface of the pressure-sensitive adhesive layer of the pressure-sensitive double-sided tape, leading to occurrence of such a failure that the release paper peels from the pressure-sensitive adhesive layer.

The laminated polishing pad of the present invention may have a circular shape, or may have a long shape. Although the size of the laminated polishing pad can be adjusted as needed according to a polishing device to be used, the laminated polishing pad has a diameter of about 30 to 150 cm in the case of the circular shape, and has a length of about 5 to 15 m and a width of about 60 to 250 cm in the case of the long shape.

A semiconductor device is fabricated after operation in a step of polishing a surface of a semiconductor wafer with a laminated polishing pad. The term, a semiconductor wafer, generally means a silicon wafer on which a wiring metal and an oxide layer are stacked. No specific limitation is imposed on a polishing method of a semiconductor wafer or a polishing apparatus, and polishing is performed with a polishing apparatus equipped, as shown in FIG. 1, with a polishing platen 2 supporting a laminated polishing pad 1, a polishing head 5 holding a semiconductor wafer 4, a backing material for applying a uniform pressure against the wafer and a supply mechanism of a polishing agent 3. The laminated polishing pad 1 is mounted on the polishing platen 2 by adhering the pad to the platen with a double-sided adhesive tape. The polishing platen 2 and the polishing head 5 are disposed so that the laminated polishing pad 1 and the semiconductor wafer 4 supported or held by them oppositely face each other and provided with respective rotary shafts 6 and 7. A pressure mechanism for pressing the semiconductor wafer 4 to the laminated polishing pad 1 is installed on the polishing head 5 side. During polishing, the semiconductor wafer 4 is polished by being pressed against the laminated polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Description will be given of the invention with examples, while the invention is not limited to description in the examples.

[Methods for Measurement and Evaluation]

(Measurement of Melting Temperature)

The melting temperature (melting point) of the polyester-based hot-melt adhesive was measured at a rate of temperature rise of 20° C./minute using TOLEDO DSC822 (manufactured by Mettler-Toledo International Inc.).

(Measurement of Specific Gravity)

The measurement was performed according to JIS Z 8807-1976. A 4 cm×8.5 cm adhesive layer strip (of arbitrary thickness) was cut from the polyester-based hot-melt adhesive and used as a sample for the specific gravity measurement. The sample was allowed to stand in an environment at a temperature of 23° C.±2° C. and a humidity of 50%±5% for 16 hours. The sample was measured for specific gravity using a specific gravity meter (manufactured by Sartorius AG).

(Measurement of Melt Flow Index (MI))

The melt flow index of the polyester-based hot-melt adhesive was measured according to ASTM-D-1238 under the conditions of 150° C. and 2.16 kg.

(Measurement of Warpage of Laminated Polishing Pad)

The prepared laminated polishing pad was left standing on a horizontal table, and the height (elevation distance), from the table, of a part of the pad edge having largest warpage was measured.

(Evaluation of External Appearance of Laminated Polishing Pad)

Presence/absence of wrinkles on the surface of the cushion layer of the prepared laminated polishing pad was visually checked. Whether or not peeling occurred at the cut part of the release paper of the pressure-sensitive double-sided tape was visually checked. A laminated state of the polishing layer and the cushion layer was evaluated in accordance with the following criteria.

○: the outer periphery of the polishing layer coincides with the outer periphery of the cushion layer.

X: the laminate is cut such that the outer periphery of the cushion layer has a size a little larger than that of the outer periphery of the polishing layer.

(Measurement of Shear Stress)

Three samples of 25 mm×25 mm were cut out from the prepared laminated polishing pad, the polishing layer and the cushion layer of each of the samples were stretched at a tensile speed of 300 mm/min under an environment of 80° C., and the sheer stress (N/25 mm) at this time was measured. The average for three samples is shown in Table 1. The shear stress is preferably 250 N/25 mm or more.

Production Example 1

Preparation of Polishing Layer

To a vessel were added 1,229 parts by weight of toluene diisocyanate (a mixture of 2,4-diisocyanate/2,6-diisocyanate=80/20), 272 parts by weight of 4,4'-dicyclohexylmethane diisocyanate, 1,901 parts by weight of polytetramethylene ether glycol with a number average molecular weight of 1,018, and 198 parts by weight of diethylene glycol, and allowed to react at 70° C. for 4 hours, so that an isocyanate-terminated prepolymer was obtained.

To a polymerization vessel were added 100 parts by weight of the prepolymer and 3 parts by weight of a silicone surfactant (SH-192 manufactured by Dow Corning Toray Co., Ltd.) and mixed. The mixture was adjusted to 80° C. and degassed under reduced pressure. Subsequently, the reaction system was vigorously stirred for about 4 minutes with a stirring blade at a rotational speed of 900 rpm so that air bubbles were incorporated into the reaction system. Thereto was added 26 parts by weight of MOCA (CUAMINE-MT, manufactured by IHARA CHEMICAL INDUSTRY CO., LTD.), whose temperature was adjusted to 120° C. in advance. The liquid mixture was stirred for about 1 minute and then poured into a pan-shaped open mold (casting vessel). At the point when the liquid mixture lost its fluidity, it was placed in an oven, and subjected to post curing at 100° C. for 16 hours, so that a polyurethane resin foam block was obtained.

While heated at about 80° C., the polyurethane resin foam block was sliced using a slicer (VGW-125 manufactured by AMITEC Corporation), so that a polyurethane resin foam sheet (50 μm in average cell diameter, 0.86 in specific gravity, and 52 degrees in hardness) was obtained. In a buffing machine (manufactured by AMITEC Corporation), the surface of the sheet was then buffed subsequently using #120, #240, and #400 sandpaper, until its thickness reached 2 mm, so that a sheet with regulated thickness accuracy was obtained. The buffed sheet was stamped into a piece with a diameter of 61 cm. Concentric circular grooves with a width 0.25 mm, a pitch of 1.5 mm, and a depth of 0.6 mm were formed on the surface of the piece using a grooving machine (manufactured by Techno Corporation), so that a polishing layer was obtained.

Production Example 2

Preparation of Cushion Layer with Peelable Base Material

A foamed urethane composition was applied onto a 50 μm-thick PET base material (Purex manufactured by Teij in DuPont Films Japan Limited) having been subjected to a peelability imparting treatment, and was cured to form a cushion layer (specific gravity: 0.5, ASKER C hardness: 50 degrees; thickness: 125 μm), thereby preparing a cushion layer with a base material.

Production Example 3

Preparation of Cushion Layer with Non-Peelable Base Material

A foamed urethane composition was applied onto a 50 μm-thick PET base material (Tetoron G2 manufactured by Teijin DuPont Films Japan Limited) having been subjected to a corona treatment, and was cured to form a cushion layer (specific gravity: 0.5, ASKER C hardness: 50 degrees; thickness: 125 μm), thereby preparing a cushion layer with a base material.

Example 1

A hot-melt adhesive sheet (thickness: 50 μm) formed of a polyester-based hot-melt adhesive containing 100 parts by weight of a crystalline polyester resin (VYLON GM 420 manufactured by TOYOBO CO., LTD.) and 5 parts by weight of an o-cresol novolak type epoxy resin having two or more glycidyl groups in the molecule (EOCN 4400 manufactured by Nippon Kayaku Co., Ltd.) was laminated on the cushion layer of the cushion layer with a peelable base material as prepared in Production Example 2, and the sheet surface was heated to 150° C. with an infrared heater to melt the hot-melt adhesive. Thereafter, the polishing layer prepared in Production Example 1 was laminated on the melted hot-melt adhesive using a laminator, and the resultant was made to pass between rolls to be press-bonded, thereby preparing a laminate. While the laminate was cooled, the laminate was cut to the size of the polishing layer with a cutter when the temperature of the hot-melt adhesive was 40° C. or higher, thereby preparing a laminated polishing sheet, and the PET base material was peeled from the laminated polishing sheet. Thereafter, a pressure-sensitive double-sided tape (442 JA manufactured by 3M Company) having a pressure-sensitive adhesive layer on both surfaces of a 25 μm-thick PET sheet was bonded to the PET base material-peeled surface of the cushion layer using a laminator, and the pressure-sensitive double-sided tape was cut to the size of the polishing layer with a cutter to prepare a laminated polishing pad. The polyester-based hot-melt adhesive had a melting temperature of 142° C., a specific gravity of 1.22, and a melt flow index of 21 g/10 minutes.

Example 2

A laminated polishing pad was prepared in the same manner as in Example 1 except that the sheet surface was heated to 140° C. with an infrared heater to soften the hot-melt adhesive.

Example 3

A laminated polishing pad was prepared in the same manner as in Example 1 except that the sheet surface was heated to 170° C. with an infrared heater to melt the hot-melt adhesive.

Example 4

A laminated polishing pad was prepared in the same manner as in Example 1 except that a pressure-sensitive double-sided tape having a pressure-sensitive adhesive layer on both surfaces of a 100 μm-thick PET sheet was used.

Comparative Example 1

The hot-melt adhesive sheet used in Example 1 was laminated on the cushion layer of the cushion layer with a non-peelable base material as prepared in Production Example 3, and the sheet surface was heated to 150° C. with an infrared heater to melt the hot-melt adhesive. Thereafter, the polishing layer prepared in Production Example 1 was laminated on the melted hot-melt adhesive using a laminator, and the resultant was made to pass between rolls to be press-bonded, thereby preparing a laminate. Then, the laminate was cooled to completely cure the hot-melt adhesive. Thereafter, the laminate was cut to the size of the polishing layer with a cutter. Further, the pressure-sensitive double-sided tape (442 JA manufactured by 3M Company) was bonded to the PET base material of the cushion layer with a base material using a laminator, and the pressure-sensitive double-sided tape was cut to the size of the polishing layer with a cutter to prepare a laminated polishing pad.

Comparative Example 2

The hot-melt adhesive sheet used in Example 1 was laminated on a 1.25 mm-thick cushion layer formed of a polyurethane foam (NIPPALAY EXG manufactured by NHK Spring Co., Ltd.), and the sheet surface was heated to 150° C. with an infrared heater to melt the hot-melt adhesive. Thereafter, the polishing layer prepared in Production Example 1 was laminated on the melted hot-melt adhesive using a laminator, and the resultant was made to pass between rolls to be press-bonded, thereby preparing a laminate. Then, the laminate was cooled to completely cure the hot-melt adhesive. Thereafter, the laminate was cut to the size of the polishing layer with a cutter. Further, the pressure-sensitive double-sided tape (442 JA manufactured by 3M Company) was bonded to the other surface of the cushion layer using a laminator, and the pressure-sensitive double-sided tape was cut to the size of the polishing layer with a cutter to prepare a laminated polishing pad.

Comparative Example 3

A laminated polishing pad was prepared in the same manner as in Comparative Example 1 except that the sheet surface was heated to 120° C. with an infrared heater to soften the hot-melt adhesive.

TABLE 1

| | Heating temperature of hot-melt adhesive (° C.) | Type of cushion layer | Thickness of PET sheet of pressure-sensitive double-sided tape (μm) | Warpage of pad (mm) | Presence/ absence of wrinkles | Presence/ absence of "peeling" | Laminated state | Shear stress (N/25 mm) |
|---|---|---|---|---|---|---|---|---|
| Example 1 | 150 | With peelable base material | 25 | 0 | Absent | Absent | ○ | 290 |
| Example 2 | 140 | With peelable base material | 25 | 0 | Absent | Absent | ○ | 276 |
| Example 3 | 170 | With peelable base material | 25 | 0 | Absent | Absent | ○ | 310 |
| Example 4 | 150 | With peelable base material | 100 | 0 | Absent | Absent | ○ | 290 |
| Comparative Example 1 | 150 | With non-peelable base material | 25 | 15 | Absent | Present | x | 292 |
| Comparative Example 2 | 150 | No base material | 25 | 0 | Present | Absent | ○ | 289 |
| Comparative Example 3 | 120 | With non-peelable base material | 25 | 0 | Absent | Absent | ○ | 234 |

The laminated polishing pads of Examples 1 to 4 were free from warpage, had no wrinkles on the surface of the cushion layer, and were excellent in adhesion between the polishing layer and the cushion layer under a high-temperature environment. On the other hand, the laminated polishing pad of Comparative Example 1 was significantly warped because a cushion layer with a non-peelable base material was used. Further, "peeling" occurred at the cut part of the release paper of the pressure-sensitive double-sided tape. The laminated polishing pad of Comparative Example 2 had wrinkles at the surface of the cushion layer because a cushion layer that was not provided with a base material was used. The laminated polishing pad of Comparative Example 3 was insufficient in adhesion between the polishing layer and the cushion layer under a high-temperature environment because the temperature, at which the hot-melt adhesive was softened, was low.

INDUSTRIAL APPLICABILITY

A laminated polishing pad of the invention is capable of performing planarization materials requiring a high surface planarity such as optical materials including a lens and a reflective mirror, a silicon wafer, a glass substrate or an aluminum substrate for a hard disk and a product of general metal polishing with stability and a high polishing efficiency. A laminated polishing pad of the invention is preferably employed, especially, in a planarization step of a silicon wafer or a device on which an oxide layer or a metal layer has been formed prior to further stacking an oxide layer or a metal layer thereon.

DESCRIPTION OF REFERENCE SIGNS

In the drawings, reference numeral 1 represents a laminated polishing pad, 2 a polishing platen, 3 a polishing agent (slurry), 4 an object to be polished (semiconductor wafer), 5 a support (polishing head), 6 and 7 each a rotating shaft.

The invention claimed is:

1. A method for producing a laminated polishing pad comprising the following steps in this order:

laminating a hot-melt adhesive sheet to a surface of a cushion layer with a base material in which a thermoplastic resin base material is provided peelably on one surface of the cushion layer, on which the thermoplastic resin base material is not provided;

heating the laminated hot-melt adhesive sheet to be melted or softened;

laminating a polishing layer on the melted or softened hot-melt adhesive to prepare a laminate;

cutting the laminate to the size of the polishing layer to prepare a laminated polishing sheet; and peeling the thermoplastic resin base material from the laminated polishing sheet.

2. The method for producing a laminated polishing pad according to claim 1, wherein the laminated polishing sheet is prepared by cutting the laminate to the size of the polishing layer before the melted or softened hot-melt adhesive is completely cured.

3. The method for producing a laminated polishing pad according to claim 2, wherein the thermoplastic resin base material is peeled from the laminated polishing sheet after the hot-melt adhesive is completely cured.

4. The method for producing a laminated polishing pad according to claim 1, wherein the laminated polishing sheet is prepared by cutting the laminate to the size of the polishing layer when the temperature of the hot-melt adhesive is 40° C. or higher.

5. The method for producing a laminated polishing pad according to claim 1, wherein the thermoplastic resin base material is formed by stretch forming.

6. The method for producing a laminated polishing pad according to claim 1, wherein the melting temperature of the hot-melt adhesive is 140 to 170° C.

7. The method for producing a laminated polishing pad according to claim 1, wherein the thermoplastic resin base material is a polyethylene terephthalate base material.

8. The method for producing a laminated polishing pad according to claim 1, comprising the step of providing a pressure-sensitive double-sided tape, which has a pressure-sensitive adhesive layer on both surfaces of a thermoplastic resin sheet, on a surface of the cushion layer from which the thermoplastic resin base material is peeled.

9. A method for producing a laminated polishing pad comprising the following steps in this order:

applying a melted or softened hot-melt adhesive to a surface of a cushion layer with a base material in which a thermoplastic resin base material is provided peelably on one surface of the cushion layer, on which the thermoplastic resin base material is not provided;

laminating a polishing layer on the melted or softened hot-melt adhesive to prepare a laminate;

cutting the laminate to the size of the polishing layer to prepare a laminated polishing sheet; and peeling the thermoplastic resin base material from the laminated polishing sheet.

10. The method for producing a laminated polishing pad according to claim 9, wherein the laminated polishing sheet is prepared by cutting the laminate to the size of the polishing layer before the melted or softened hot-melt adhesive is completely cured.

11. The method for producing a laminated polishing pad according to claim 10, wherein the thermoplastic resin base material is peeled from the laminated polishing sheet after the hot-melt adhesive is completely cured.

12. The method for producing a laminated polishing pad according to claim 9, wherein the laminated polishing sheet is prepared by cutting the laminate to the size of the polishing layer when the temperature of the hot-melt adhesive is 40° C. or higher.

13. The method for producing a laminated polishing pad according to claim 9, wherein the thermoplastic resin base material is formed by stretch forming.

14. The method for producing a laminated polishing pad according to claim 9, wherein the melting temperature of the hot-melt adhesive is 140 to 170° C.

15. The method for producing a laminated polishing pad according to claim 9, wherein the thermoplastic resin base material is a polyethylene terephthalate base material.

16. The method for producing a laminated polishing pad according to claim 9, comprising the step of providing a pressure-sensitive double-sided tape, which has a pressure-sensitive adhesive layer on both surfaces of a thermoplastic resin sheet, on a surface of the cushion layer from which the thermoplastic resin base material is peeled.

* * * * *